US009190731B2

(12) United States Patent
Lewis et al.

(10) Patent No.: US 9,190,731 B2
(45) Date of Patent: Nov. 17, 2015

(54) RADAR ANTENNA

(75) Inventors: Gareth Michael Lewis, Colchester (GB); Robert Alan Lewis, Maldon (GB); Larry Brian Tween, Chelmsford (GB); Gary David Panaghiston, Billericay (GB); Ronald Frank Edward Guy, Maldon (GB)

(73) Assignee: BAE SYSTEMS plc, London (GB)

( * ) Notice: Subject to any disclaimer, the term of this patent is extended or adjusted under 35 U.S.C. 154(b) by 263 days.

(21) Appl. No.: 13/511,076

(22) PCT Filed: Nov. 25, 2010

(86) PCT No.: PCT/GB2010/051967

§ 371 (c)(1),
(2), (4) Date: May 21, 2012

(87) PCT Pub. No.: WO2011/064587

PCT Pub. Date: Jun. 3, 2011

(65) Prior Publication Data

US 2013/0069840 A1 Mar. 21, 2013

(30) Foreign Application Priority Data

Nov. 27, 2009 (EP) ..... 09252695
Nov. 27, 2009 (GB) ..... 0920920.6

(51) Int. Cl.
*H01Q 21/26* (2006.01)
*H01Q 9/04* (2006.01)
(Continued)

(52) U.S. Cl.
CPC ..... *H01Q 9/0407* (2013.01); *H01Q 9/28* (2013.01); *H01Q 15/0013* (2013.01)

(58) Field of Classification Search
CPC .... H01Q 9/0407; H01Q 9/28; H01Q 15/0013
USPC ..... 343/798, 909
See application file for complete search history.

(56) References Cited

U.S. PATENT DOCUMENTS 3,016,502 A 1/1962 Unger
3,089,142 A 5/1963 Wickersham, Jr.
(Continued)

FOREIGN PATENT DOCUMENTS

EP 1 684 381 A1 7/2006
WO WO 02/087012 A1 10/2002
(Continued)

OTHER PUBLICATIONS

Lovat, Giampiero et al., "Analysis of Directive Radiation from a Line Source in a Metamaterial Slab with Low Permittivity", IEEE Transactions on Antennas and Propagation (Mar. 2006), vol. 54, No. 3, pp. 1017-1030.
(Continued)

*Primary Examiner* — Hoang V Nguyen
*Assistant Examiner* — Michael Bouizza
(74) *Attorney, Agent, or Firm* — Scully, Scott, Murphy & Presser, PC

(57) ABSTRACT

A radar or other microwave antenna comprises at least one antenna element, a feed structure for the element extending to the antenna element substantially normally thereto through a dielectric substrate, and characterized in that the dielectric substrate is anisotropic whereby to reduce unwanted common-mode currents in the feed structure. The anisotropy may be provided by elongate conductive elements distributed through the dielectric substrate and aligned with their longitudinal axes parallel to the feed structure.

15 Claims, 5 Drawing Sheets

(51) Int. Cl.
*H01Q 9/28* (2006.01)
*H01Q 15/00* (2006.01)

(56) References Cited

U.S. PATENT DOCUMENTS

| | | | | |
|---|---|---|---|---|
| 4,081,803 | A * | 3/1978 | Dempsey | 343/795 |
| 4,604,629 | A | 8/1986 | Hannan | |
| 5,563,616 | A * | 10/1996 | Dempsey et al. | 343/753 |
| 5,801,660 | A * | 9/1998 | Ohtsuka et al. | 343/846 |
| 5,945,938 | A | 8/1999 | Chia et al. | |
| 6,181,280 | B1 * | 1/2001 | Kadambi et al. | 343/700 MS |
| 2003/0020655 | A1 | 1/2003 | McKinzie, III et al. | |
| 2005/0195051 | A1 | 9/2005 | McKinzie, III | |
| 2008/0136710 | A1 | 6/2008 | Nefedov et al. | |
| 2012/0146869 | A1 * | 6/2012 | Holland et al. | 343/795 |

FOREIGN PATENT DOCUMENTS

| | | | |
|---|---|---|---|
| WO | WO 03/012919 | A1 | 2/2003 |
| WO | WO 2006/036616 | A2 | 4/2006 |
| WO | WO 2008/085552 | A2 | 7/2008 |
| WO | WO 2009/047553 | A1 | 4/2009 |

OTHER PUBLICATIONS

International Search Report dated Mar. 9, 2011 issued in PCT/GB2010/051967.
Extended European Search Report dated May 20, 2010 issued in EP 09252695.3.
UK Search Report dated Mar. 24, 2010 issued in GB 0920920.6.
International Preliminary Report on Patentability and Written Opinion, dated Jun. 7, 2012 from related International Application No. PCT/GB2010/051967.

* cited by examiner

RADAR ANTENNA

FIELD OF THE INVENTION

This invention relates to radar and other microwave antennas. By "microwave antenna" we mean one having an operating frequency of at least 300 MHz. The invention is particularly but not exclusively suitable for phased arrays.

Phased array antenna systems are well known in the antenna art. Such antennas generally comprise a plurality of radiating antennas that are individually controllable with regard to relative phase and amplitude. The antenna pattern of the array is selectively determined by the geometry of the individual antennas and the selected phase/amplitude relationships among the antennas. Typical radiating elements for such antenna systems may comprise dipoles, slots or any other suitable arrangement.

Microwave antennas include a wide variety of designs for various applications, such as satellite reception, remote broadcasting, or military communication. For low profile applications printed circuit antennas may be used.

RELATED ART

A schematic diagram of a low profile, highly coupled dipole array is illustrated in FIG. 1. This particular array comprises a periodic arrangement of dipoles each having a span (periodicity) of around 10 mm. The target bandwidth of the antenna array is approximately 2 GHz to 18 GHz. Such antennas are more attractive for use in a low profile antenna than antennas using Vivaldi elements, for example, which are much taller for a similar range of frequencies.

Such a dipole array usually forms part of a layered structure, including a dielectric substrate upon which the dipole array is printed and dielectric spacer material separating the dipole array from a ground plane. Further dielectric layers may also be included to improve the performance at wide scan angles.

However, there is a problem with using such a highly coupled dipole array for applications requiring a low profile antenna. Such antennas have a so-called "vertical" feed structure to connect the elements of the dipole array to a driving circuit which extends through the ground plane. By "vertical" is meant substantially normal or perpendicular to the plane of the dipole array.

A problem arises with feeding a planar array of dipoles, for example, because the vertical feed structure will support unwanted currents. In a scanned array, these unwanted currents are present even when using a balanced feed structure such as twin wire transmission line. These currents are excited at the frequencies and range of scan angles over which the antenna will work effectively.

In order to avoid the problem of such unwanted common-mode currents due to the feed structure it would be possible to feed an array of dipoles using an optical fibre feeding an active device. However, this solution would be expensive and largely constrained to receive-only applications due to the limited transmit power. Furthermore whilst an optical feed structure might be possible at lower frequencies which mean larger dipole structures due to larger wavelengths this will become less feasible for smaller dipole structures such as those working around 10 GHz.

It is desirable to produce a phased array antenna having high bandwidth and high scan range whilst also having a low profile and being light in weight. Of course, it is also desirable to produce such antenna at as low a cost as possible.

Our co-pending patent application, published as WO 2009/047553, seeks to provide one solution to this problem of unwanted common-mode currents by at least partially surrounding each feed structure with a ferrite element to suppress the unwanted currents over the feed structure. The present invention offers an alternative approach.

In one aspect the invention provides a radar or other microwave antenna comprising at least one antenna element, a feed structure for the element extending to the antenna element substantially normally thereto through a dielectric substrate, and characterized in that the dielectric substrate is anisotropic thereby to reduce unwanted common-mode currents in the feed structure.

The invention also provides an antenna array (which may be a phased array) having a number of antenna elements as set forth above. The following optional features may be included in the antenna element or the array, as appropriate.

The dielectric substrate may selectively present an impedance to electric fields polarized in a first direction, parallel to the feed structure, which is relatively high compared to an impedance presented to electric fields polarized orthogonally to that first direction.

The dielectric substrate may comprise elongate electrically conductive elements having their longitudinal axes generally aligned in the first direction, and being distributed through the dielectric substrate. The pins may therefore be distributed to surround the feed structure. Such distribution of the electrically conductive elements throughout the substrate may provide that the electrically conductive elements are disposed beneath an antenna element, or in other words: the conductive element axis may be coincident with the antenna element.

Thus in another aspect the invention provides a radar or other microwave antenna comprising at least one antenna element disposed in an antenna substrate, a feed structure for the element extending to the element substantially normally thereto through a dielectric substrate, and characterized by an array of discrete elongate elements distributed through the dielectric substrate, the elements being spaced from the feed structure and disposed with their longitudinal axes aligned in a first direction that is parallel to the feed structure.

The elongate elements may present relatively high impedance to electric fields polarized in that first direction.

The antenna elements may be spaced apart in at least one direction, the spacing of the elongate elements in that at least one direction being regular from element to element and being a sub-multiple of the dimension (periodicity) of the antenna elements in that at least one direction.

Thus the antennas may be spaced apart in two orthogonal directions, the spacing of the elongate elements in each of the two orthogonal directions being a sub-multiple of the dimension (periodicity) of the antenna elements in each of those two orthogonal directions.

The said spacing of the elongate elements may be one half to one eighth and preferably one fourth of the respective dimension of the antenna elements.

The elongate elements may be spaced apart by a distance several times less, for example 4 to 16 times less, preferably 8 times less than the shortest wavelength of signals which the antenna is designed to transmit or receive.

The antenna elements may comprise pairs of dipoles, one of which dipoles is aligned in a second direction, the other of which is aligned orthogonally to the first and second directions.

The elongate elements may extend only partially through the thickness of the dielectric substrate normal to the antenna element.

The dielectric material may extend from the antenna element to a ground plane disposed substantially parallel to said antenna element, the elongate elements having ends spaced from at least one of the substrate and the ground plane.

The length of the elongate elements may be between 50% and 90% of the distance between the antenna element and the ground plane, and preferably about 70%. The elongate elements may be rod-like.

The elongate elements may be circular in section and have a length to diameter ratio in the range of between 5 and 15 to 1 and preferably 7 to 1.

The elongate elements in operation may couple capacitively to the ground plane.

The elongate elements may be made of copper or aluminium or other electrically conducting materials.

The dielectric substrate may be of a material of relatively low dielectric constant, preferably chosen from amongst low density foam materials such as closed-cell polyurethane foam.

The invention will now be described merely by way of example with reference to the accompanying drawings, wherein.

Figures 4A, 4B:
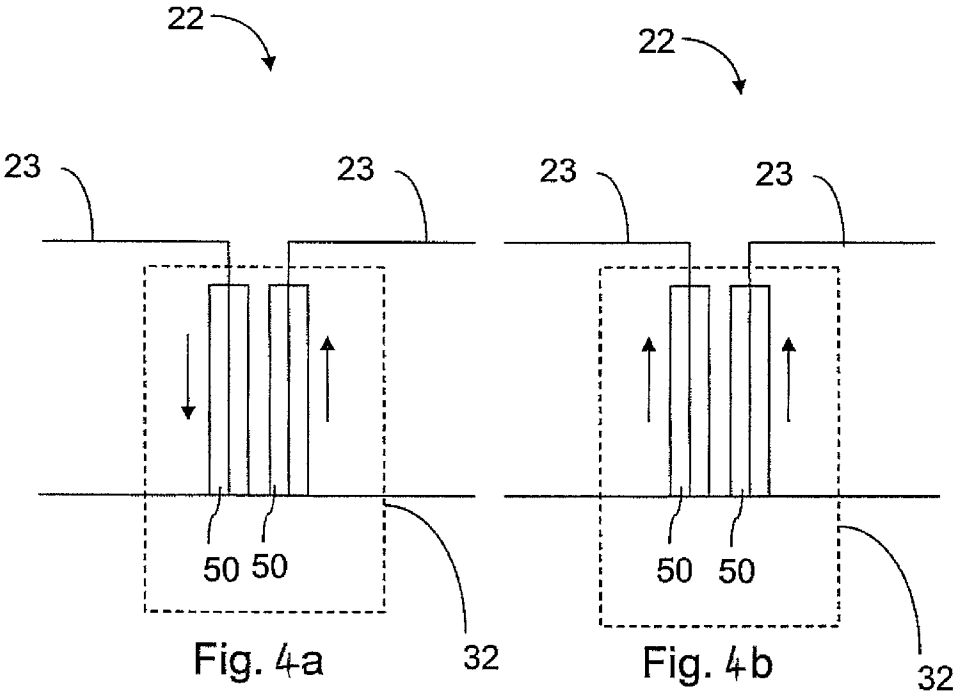

FIG. 4*a* is an illustration of balanced currents in a feed structure;

FIG. 4*b* is an example of an unbalanced current in a feed structure, and

Figure 5:
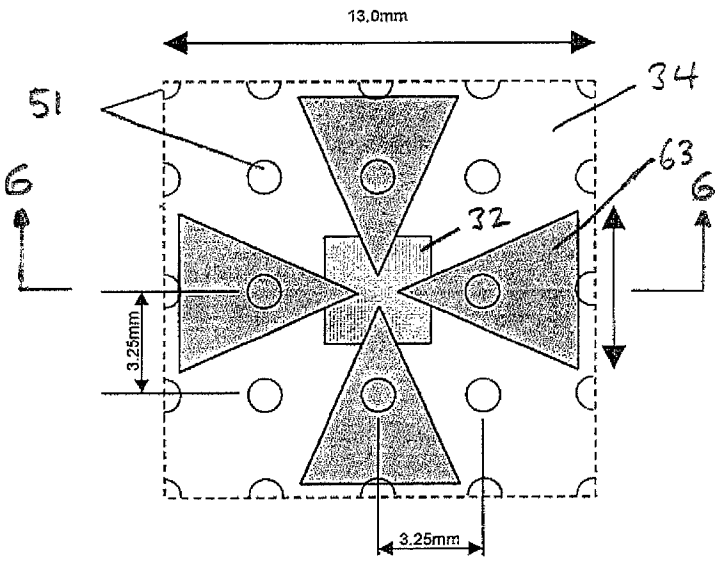
Figure 6:
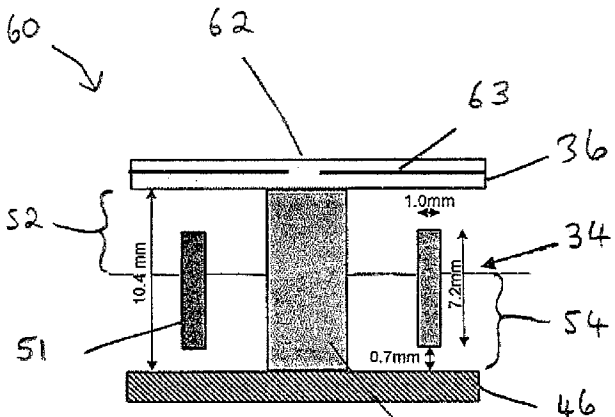

FIGS. 5 and 6 are an illustration of an embodiment of the present inventions, FIG. 6 being a section on line 6-6 of FIG. 5.

DETAILED DESCRIPTION

Figure 1:
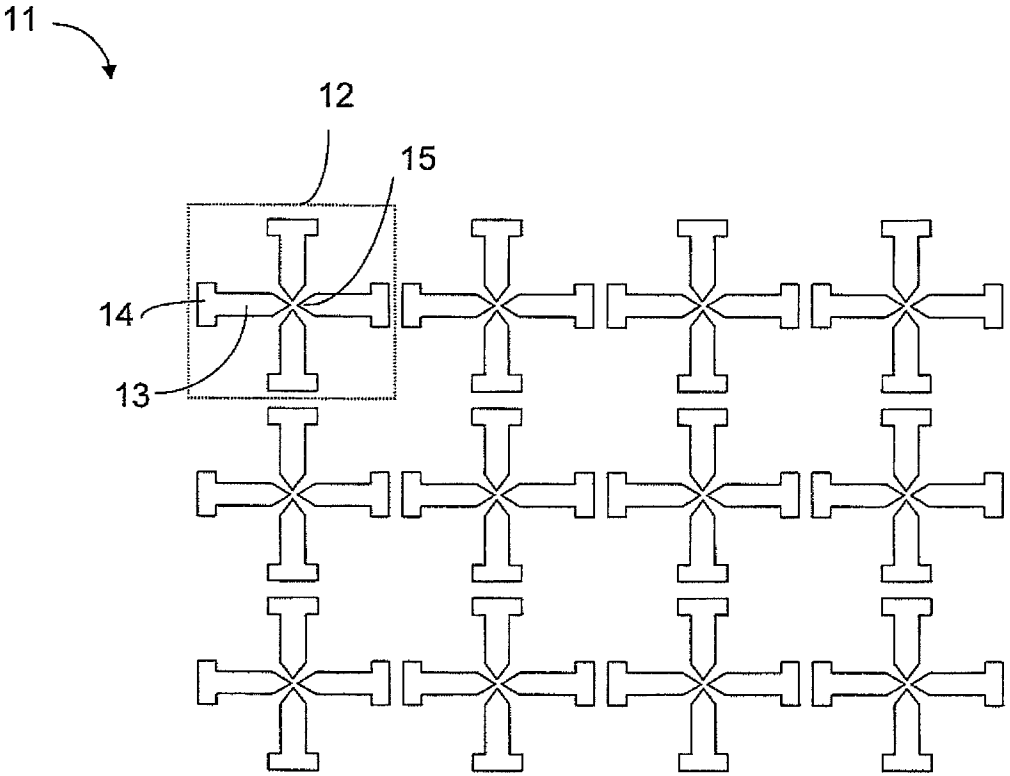
FIG. 1 is an illustration of one example of a highly coupled dipole array for use in a phased array antenna.

FIG. 1 illustrates schematically a highly coupled dipole array 11 comprising a substantially planar periodic arrangement of antenna elements 12. Each antenna element 12 comprises four conducting arms 13 which form two orthogonal dipole antennas and provide dual polarisation. T-shaped elements 14 at the end of each arm 13 increase the series capacitance between adjacent antenna elements 12 in order to improve the antenna bandwidth. Each conducting arm has a feed portion 15 located at the centre of the antenna element 12 for receiving an electrical signal. A dielectric substrate for supporting the dipole array 11 (as is conventional in printed circuit antennas) is not shown.

Figure 2:
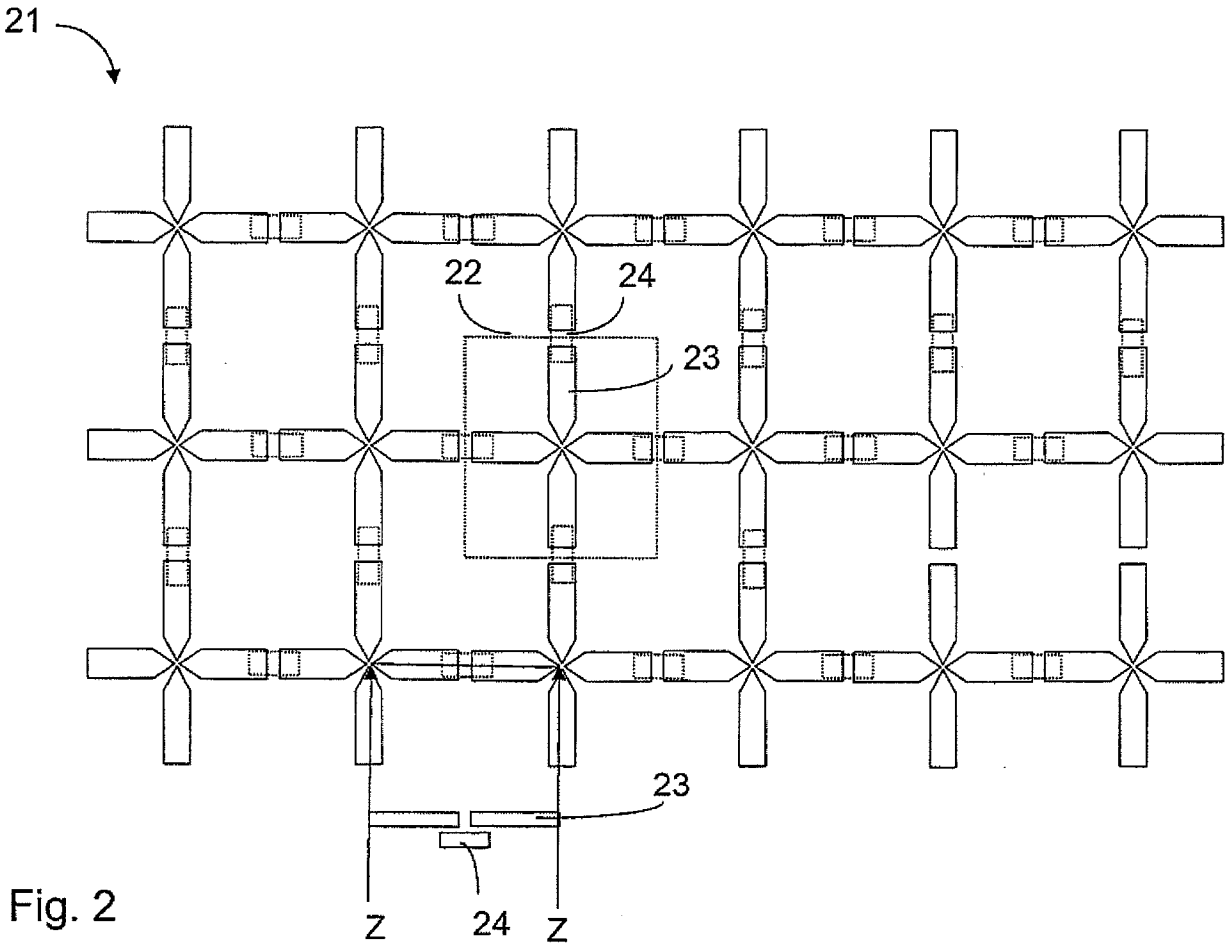
FIG. 2 is a second example of a highly coupled dipole array for use in a phased array antenna.

FIG. 2 illustrates schematically a second example of a highly coupled dipole array 21 comprising a substantially planar periodic arrangement of antenna elements 22 supported by a thin dielectric substrate (not shown in FIG. 2). Each antenna element 22 comprises four substantially identical conducting arms 23 which form two orthogonal dipole antennas and provide dual polarisation. Parallel line coupling elements 24 which are provided on the opposite side of the thin dielectric substrate to that of the dipole elements serve to increase the series capacitance between adjacent antenna elements 22 in order to improve the antenna bandwidth. A section Z-Z of the antenna array is shown in FIG. 2 (with the thickness of the arms 23 and the coupling element 24 greatly exaggerated) to illustrate a side view of a coupling element 24.

It will be appreciated that the arrangement shown in FIG. 2 is not as convenient as the arrangement shown in FIG. 1 if it is desired to produce a dipole array spanning more than one substrate section as a coupling element 24 would have to span two substrate sections.

Figure 3:
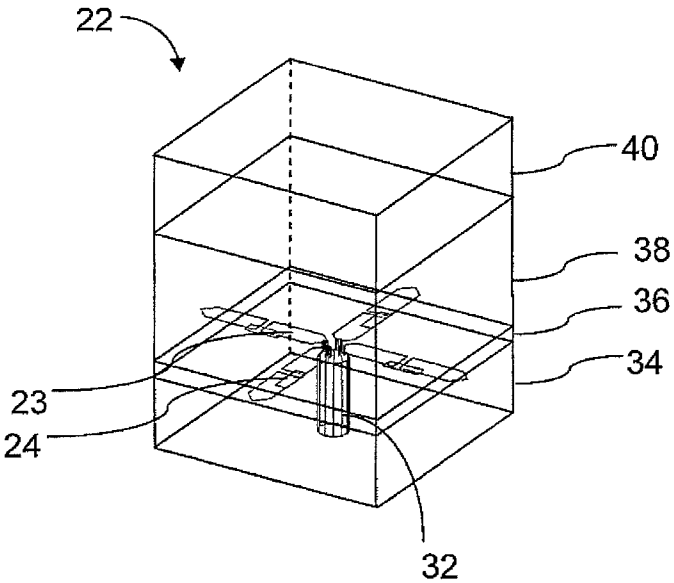
FIG. 3 is an illustration of an antenna element showing various layers in an antenna structure.

FIG. 3 is a perspective view of an antenna element 22 shown in FIG. 2 illustrating the layers which were used in an antenna simulation. The antenna element 22 includes a feed structure 32 comprising a coaxial cable feeding each conducting arm 23 (a conducting arm from each of four adjacent antenna elements are also shown). A spacer layer 34 of a dielectric material separates the layer of conducting arms 23 from a ground plane layer (not shown). A relatively thin dielectric substrate layer 36 supports the conducting arms 23 and coupling elements 24.

Because the substrate layer 36 has a dielectric constant of 2.2 and air has a dielectric constant of approximately 1, further dielectric layers—a first dielectric layer 38 and a second dielectric layer 40—are provided to cover the layer of conducting arms 23 to smooth the differences in the dielectric properties between the substrate 36 and air and to improve the scan angle of an antenna array 21 made up of a periodic structure of the antenna elements 22. In this example, a first dielectric layer 38 having a dielectric constant of 2.0 supports a second dielectric layer 40 having a dielectric constant of 1.33 between the substrate layer 36 and air. In this description the feed structure is sometimes referred to as a vertical feed structure, although it will be appreciated that an antenna array 21 may be in any orientation when in use.

The effective scanning angle of a phased array antenna is limited by the voltage standing wave ratio (VSWR) achieved in the feed structure when phases are applied to the antenna elements in order to scan in the plane of the electric field (the E plane) and the plane of the magnetic field (the H plane) which are orthogonal to one another. Predictions of the VSWR performance can be generated using conventional antenna modelling software.

Ideally the VSWR should be below 2:1 but a ratio of 2.5:1 can be tolerated for very wide bandwidth and scan angle operation.

Excessive VSWR can arise due to unwanted currents in the feed structure 32. FIGS. 4*a* and 4*b* show conductive arms 23 fed by a feed structure 32, each conductive arm 23 being fed by a coaxial cable 50. FIG. 4*a* illustrates, by means of arrows, balanced currents in the feed structure. FIG. 4*b* on the other hand shows undesirable unbalanced or common mode currents which if not suppressed will cause noise in signals received by the conductive arms 23.

In a preferred embodiment of the invention, shown in FIGS. 5 and 6, the undesirable common mode currents are suppressed by concentrating the horizontally propagating vertically-polarized electric fields which produce them into an array of conductive rods distributed through the dielectric material of spacer layer 34 surrounding and spaced apart from the feed structures 32. The dimensions of the rods are chosen to cause the currents to dissipate rather than travel in the feed structure. Furthermore, the spacing and distribution of the rods is chosen so as to appear homogeneous to signals at the operational wavelengths for the antenna.

Referring to FIGS. 5 and 6 (in which previously described items are labelled with the same reference numerals), an antenna element structure 60 is shown in which conducting elements 63 of an antenna element 62 are in this embodiment triangular in shape so as to increase the series capacitance between the conducting elements 63 of adjacent antenna elements 62. The dielectric layers 38 and 40 of FIG. 3 are present also in this structure 60, although not shown. The feed structure 32 is located at the centre of the antenna element structure 60 in a manner already described with reference to FIGS. 1 and 3.

The feed structure 32 and the conducting elements 63 in this example are set at a pitch of 13 mm in both the x and y directions in the substrate layer 36. Thus, the periodicity of antenna elements in an array antenna comprising a periodic arrangement of the square antenna elements 62 is 13 mm. The substrate layer 36 is positioned 10.4 mm above a base substrate 46 which includes a strip-line ground plane.

The spacer layer 34 consists of material of a relatively low dielectric constant (for example polyurethane foam, which has a dielectric constant approximating to that of free space, or other low density foam) in which are distributed an array of parallel, vertical, substantially equally spaced elongate rods 51 of for example copper or aluminium alloy or other electrically conducting material. The rods 51 are set at a pitch of 3.25 mm in the x and y directions, one quarter the (13 mm) pitch of the antenna elements 62. The antenna array is designed for use at a maximum frequency of 11.5 GHz, equivalent to a wavelength of 26 mm. The pitch of the conductive rods 51 is thus one eighth of a wavelength and that of the antenna elements is one half of the wavelength of the highest frequency signals for which the antenna is designed.

In this example the rods are 7.2 mm long and are of circular section with a diameter of 1.0 mm. Their length to diameter ratio is thus 7.2:1. The rods 51 are suspended in the dielectric material 34 so that the lower end of each rod 51 is 0.7 mm from the ground plane and the upper end is 2.5 mm from the underside of the substrate layer 36. The lower end of the rod 51 is capacitively coupled to the ground plane due to its proximity thereto and acts in combination with the inductance of the rod 51 to form a tuned circuit that dissipates the energy in the unwanted electric fields. Due to the relatively large gap between the top of the rods 51 and the antenna elements 62 there is negligible coupling between them.

The elongate shape of the rods 51 and their parallel vertical orientation between the conducting elements 63 and the ground plane layer 46 results in the dielectric layer 34 having different properties in the z direction (normal to the conducting elements 63) compared to its properties in the x and y directions. This enables the vertically polarized fields inducing undesirable common-mode currents to be suppressed whilst having little effect on the horizontally polarized fields associated with the induced currents in the conducting elements 63 of the antenna elements 62 which are necessary for transmission and reception.

To facilitate manufacture, the spacer layer comprises upper and lower portions 52, 54, shown in FIG. 6, each with an array of blind holes to receive the rods 51. The rods are placed in the lower portion 54 and then the upper portion 52 is placed on top and bonded to the lower portion 54, or vice versa.

It will be appreciated that various alterations, modifications, and/or additions may be introduced into the constructions, arrangements and dimensions of parts described above without departing from the scope of the present invention as defined in the appended claims.

Although the invention has been discussed specifically referring to co-axial cables, other vertical feed structures, for example strip line or any other electrical conductor feeding an antenna array in parallel may benefit from the invention.

Although the invention has been described, using two dielectric layers 38, 40 between the antenna array and air, fewer, more or no dielectric layers may be used. Furthermore the portions 52, 54 of dielectric layer 34 may be of different materials.

Although the invention has been described in the context of arrays of antennas having four conducting arms (elements), the invention may also benefit arrays of antenna elements having two conducting arms and may also benefit other types of antenna or antenna array structures where a parallel (or 'vertical') electrical feed structure is required.

The dimensions and material properties described above relate to a specific example array antenna. However, variations are possible, according to the intended frequency range of operation of the antenna, which would be understood by a person of ordinary skill in the art and which fall within the scope of the present invention as defined in the claims.

The invention claimed is:

1. An antenna for a phased array comprising at least one antenna element, a feed structure for the antenna element extending to the antenna element substantially normally thereto through a dielectric substrate, an array of discrete elongate elements distributed through the dielectric substrate, and a ground plane, each of the discrete elongate elements of the array being spaced apart from the feed structure and disposed with their longitudinal axes aligned in a first direction that is parallel to the feed structure, each of the discrete elongate elements of the array being suspended between and separated from, each of the at least one antenna element and the ground plane.

2. An antenna according to claim 1, wherein the array of discrete elongate elements present a relatively high impedance to electric fields polarized in said first direction.

3. An antenna according to claim 1 wherein each of the discrete elongate elements of the array are spaced apart by a distance that is 4 to 16 times less than the shortest wavelength of signals that the antenna is designed to transmit or receive.

4. An antenna according to claim 1 wherein the at least one antenna element comprises pairs of dipoles, one of which dipoles is aligned in a second direction, orthogonal to said first direction, the other of which is aligned orthogonally to said first and second directions.

5. An antenna according to claim 1, wherein the array of discrete elongate elements extend only partially through the thickness of the dielectric substrate, normal to the at least one antenna element such that one end of the array of discrete elongate elements is spaced from the ground plane to be capacitively coupled to the ground plane and the a second opposite end of the array of discrete elongate elements is spaced from the at least one antenna element to be negligibly capacitively coupled to the at least one antenna element.

6. An antenna according to claim 1, wherein the discrete elongate elements are rod-like.

7. An antenna according to claim 1, wherein the elongate elements are spaced apart by a distance that is 4 to 16 times less than the shortest wavelength of signals that the antenna is designed to transmit or receive.

8. An antenna according to claim 1, wherein the dielectric substrate selectively presents an impedance to electric fields polarized in a first direction parallel to the feed structure which is relatively high compared to an impedance presented to electric fields polarised orthogonally to said first direction.

9. An antenna according to claim 8, further comprising a plurality of antenna elements and wherein the array of discrete elongate elements comprise electrically conductive elements, the array of discrete elongate elements being distributed through the dielectric substrate such that a corresponding one of the discrete elongate elements of the array is positioned below a corresponding one of the plurality of antenna elements and the ground plane, the ground plane being disposed substantially parallel to the antenna element.

10. An antenna for a phased array comprising at least one dipole antenna element, a feed structure for the dipole antenna element extending to the element substantially normally thereto through a dielectric substrate, and an array of discrete rod-like elongate elements distributed through the dielectric substrate, the discrete rod-like elongate elements being spaced apart from the feed structure and disposed with their longitudinal axes aligned in a first direction that is parallel to the feed structure, the dielectric substrate extending from the dipole antenna element to a ground plane disposed substantially parallel to said dipole antenna element, the dielectric substrate comprising a material of relatively low dielectric constant, the discrete rod-like elongate elements being suspended between and separated from, each of the at least one dipole antenna element and the ground plane and have ends spaced from the ground plane such that, in operation, they couple capacitively to the ground plane.

11. An antenna according to claim 10, wherein the length of the discrete rod-like elongate elements is between 50% and 90% of the distance between the dipoles and the ground plane.

12. An antenna according to claim 11, wherein the discrete rod-like elongate elements are circular in section and have a length to diameter ratio in the range of 5 to 15.

13. An antenna array comprising a plurality of antenna elements and a ground plane, each antenna element comprising a feed structure for the antenna element extending to the antenna element substantially normally thereto through a dielectric substrate, the dielectric substrate including a plurality of elongate electrically conductive elements having their longitudinal axes generally aligned parallel to the feed structure and being distributed through the dielectric substrate and suspended between and separated from, each of the at least one antenna element and the ground plane and, the dielectric substrate being anisotropic thereby to reduce unwanted common-mode currents in the feed structure, and wherein the dielectric substrate selectively presents an impedance to electric fields polarized in a first direction parallel to the feed structure which is relatively high compared to an impedance presented to electric fields polarised orthogonally to said first direction.

14. An array according to claim 13 wherein the antenna elements are regularly spaced apart in at least one direction, the spacing of the discrete elongate elements in said at least one direction being regular from antenna element to antenna element and being a sub-multiple of the dimension of the antenna elements in said at least one direction.

15. An array according to claim 14 wherein the antenna elements are regularly spaced apart in two orthogonal directions, the spacing of the discrete elongate elements in each of said two orthogonal directions being one half to one eighth of the respective dimension of the antenna elements.

* * * * *